US009184503B2

(12) United States Patent
Tatarnikov et al.

(10) Patent No.: US 9,184,503 B2
(45) Date of Patent: Nov. 10, 2015

(54) COMPACT CIRCULAR POLARIZATION ANTENNA SYSTEM WITH REDUCED CROSS-POLARIZATION COMPONENT

(75) Inventors: Dmitry Vitalievich Tatarnikov, Moscow (RU); Andrey Vitalievich Astakhov, Moscow (RU)

(73) Assignee: Topcon Positioning Systems, Inc., Livermore, CA (US)

( * ) Notice: Subject to any disclaimer, the term of this patent is extended or adjusted under 35 U.S.C. 154(b) by 147 days.

(21) Appl. No.: 13/814,218

(22) PCT Filed: Aug. 9, 2012

(86) PCT No.: PCT/RU2012/000446

§ 371 (c)(1),
(2), (4) Date: Feb. 4, 2013

(87) PCT Pub. No.: WO2014/025277

PCT Pub. Date: Feb. 13, 2014

(65) Prior Publication Data

US 2013/0342409 A1 Dec. 26, 2013

(51) Int. Cl.

| | |
|---|---|
| ***H01Q 7/00*** | (2006.01) |
| ***H01Q 21/29*** | (2006.01) |
| ***H01Q 9/04*** | (2006.01) |

(52) U.S. Cl.

CPC ..... *H01Q 7/00* (2013.01); *H01Q 9/0414* (2013.01); *H01Q 21/29* (2013.01)

(58) Field of Classification Search

CPC ..... H01Q 7/00; H01Q 9/0414; H01Q 21/29
See application file for complete search history.

(56) References Cited

U.S. PATENT DOCUMENTS

| | | | | |
|---|---|---|---|---|
| 5,300,936 | A | 4/1994 | Izadian | |
| 6,927,737 | B2 * | 8/2005 | Inoue | 343/727 |
| 8,164,532 | B1 | 4/2012 | Brown et al. | |
| 2003/0052825 | A1 * | 3/2003 | Rao et al. | 343/700 MS |
| 2004/0056803 | A1 | 3/2004 | Soutiaguine et al. | |
| 2009/0140930 | A1 * | 6/2009 | Tatarnikov et al. | 343/700 MS |
| 2010/0253587 | A1 * | 10/2010 | Lindenmeier et al. | 343/797 |

FOREIGN PATENT DOCUMENTS

| | | |
|---|---|---|
| EP | 0590955 | 9/1993 |
| RU | 2368040 | 9/2009 |
| WO | WO 2009133448 | 11/2009 |

OTHER PUBLICATIONS

Search report in PCT/RU2012/000446, dated Jun. 21, 2013.

* cited by examiner

*Primary Examiner* — Robert Karacsony
(74) *Attorney, Agent, or Firm* — Bardmesser Law Group

(57) ABSTRACT

Patch antennas for signals of global navigation satellite systems (GNSS) are described. A compact antenna system reduces directional diagram level in the rear hemisphere primarily for cross-polarized (left hand circularly-polarized) component. It can be used for reducing multipath reception. The antenna receives GNSS signals and includes a patch circularly-polarized radiator consisting of a radiating patch, a ground plane under it and a loop radiator coaxially located around the patch radiator. The loop radiator is excited by a separate power circuit or by a passive method where LHCP waves of MP and loop radiators in the rear hemisphere would be anti-phase added. A dual-band antenna system includes an active HF radiator, under which there is an active LF radiator under which there is a passive LF radiator, a loop HF radiator being coaxially located around the active HF radiator.

15 Claims, 7 Drawing Sheets

CONVENTIONAL ART

COMPACT CIRCULAR POLARIZATION ANTENNA SYSTEM WITH REDUCED CROSS-POLARIZATION COMPONENT

CROSS-REFERENCE TO RELATED APPLICATIONS

This application is a U.S. National Phase of PCT/RU2012/000446, filed on Jun. 7, 2012, which is incorporated by reference herein in its entirety.

BACKGROUND

1. Field of the Invention

The present invention relates to antennas, in particular, to patch antennas used in global navigation satellite systems (GNSS).

2. Description of the Related Art

Patch antenna systems are used in different radio electronic devices. They are widely applicable in ground satellite navigation systems (GPS, GLONASS, Galileo etc.), with the help of which a position of an object can be quickly and accurately determined at any point of the world. One of the main reasons for reduced GNSS positioning accuracy of land objects is related to receiving not only the line-of-sight satellite signal but also signals reflected from surrounding objects, and especially from the Earth's surface. The strength of such signals depends directly on the antenna's directional diagram (DD) in the rear hemisphere.

A right-hand circularly polarized signal (RHCP) is used as a working signal in navigation systems. Signals reflected from the Earth's surface, when there are no major surface features, are mostly left-hand circularly polarized signals (LHCP). This also holds true for signals of satellites that are at an angle over the horizon that is higher than Brewster's angle, that is, for typical soils, about 10-15 degrees over the horizon plane. Considering this, a GNSS antenna systems need to have a lower DD level in the rear hemisphere, and primarily, a lower component of the LHCP (cross-polarized) signal. A reduction in antenna weight and dimensional characteristics is also required.

The simplest method of reducing DD level in the rear hemisphere is mounting the antenna directly on a metal or impedance ground plane. However, this results in increasing antenna dimensions. Another method is the use of an additional antenna, the field of which is anti-phase-added to the main antenna field. This provides a reduction in the radiation level of the rear hemisphere. U.S. Pat. No. 6,836,247 B2 shows a design of a circularly-polarized antenna in the form of two patch (MP) radiators axial-symmetrically disposed one under another (see FIG. 1*a*). A ground plane of the top radiator is under a radiating patch, and a ground plane of the bottom radiator is over the radiating patch. In an isolated cavity of the ground planes, there is a low-noise amplifier (LNA). The top radiator is actively excited by pins; the bottom radiator is passively excited. Such a design provides a noticeable reduction in LHCP field only in the vicinity of anti-normal direction, while the antenna's vertical dimension still remains very large.

Modern high-precision positioning receivers employ signals of different frequencies. Operating GPS frequencies are 1575 MHz (L1-band), 1227 MHz (L2-band) and a frequency of 1175 MHz (L5-band) was recently added. GLONASS and GALILEO satellite systems also broadcast some operating frequencies. In total, the operating frequencies of GNSS systems lie in two frequency ranges: low-frequency (LF 1165-1300 MHz) and high-frequency (HF 1525-1605 MHz).

Antennas of high-precision navigation devices need to operate in the both frequency bands. In most cases, antenna designs include two radiators operating at their own frequencies. U.S. Pat. No. 6,836,247 B2 describes a dual-band stacked antenna (FIG. 1*b*). Such a combined antenna includes two active MP radiators disposed one over the other, and two passive ones. The radiating patch of the low-frequency radiator serves as a ground plane of the high-frequency radiator. Bandwidth expansion of each radiator is normally attained by increasing the distance between the radiating patch and ground plane, i.e., increasing the thickness of MP radiator. Note that an increase in LF radiator thickness results in increasing the distance between active and passive HF radiators. This, in turn, causes reduction in their coupling and excitation level of the passive radiator, and, hence in the antenna's less efficient operation.

The proposed technical solution is intended at solving cross-polarized (LHCP) field suppression problems in a wide angle sector of the rear hemisphere, enhancing the operation of the passive HF radiator in the dual-band antenna, and reducing antenna dimensions.

SUMMARY OF THE INVENTION

An antenna system for receiving navigation satellite signals is proposed, comprising a patch radiator consisting of a radiating patch disposed over a ground plane which is excited by, for example, exciting electric pins or slots, from a connected power circuit of the MP radiator, and a horizontal loop radiator axially disposed around the MP radiator. The radiating patch and ground patch can have the same dimensions, or the radiating patch can be larger or smaller than the ground patch. A cavity can be made directly under the ground patch, where power circuits of the loop radiator and the MP radiator can be located.

The loop radiator is a conducting ring, for example, made of wire or conductive film; its vertical axis matches the symmetry axis of the MP radiator. In another embodiment, the loop radiator can be disposed at the same distance from the surface of the radiating and ground patches, or it can be shifted toward the ground plane. Inductive elements can be sequentially connected with the loop radiator.

The loop radiator is excited by transmission lines at least at one point, for example, by two-wire transmission lines connected to the power supply circuit of the loop radiator. The power supply lines provide excitation of right hand circularly-polarized waves in the direction of DD maximum. The antenna system also includes a dividing circuit, whose input is the input of the antenna, and the power supply circuits of MP and loop radiators are connected to the outputs. The power supply circuits provide anti-phase excitation of LHCP waves for the MP and loop radiators in the rear hemisphere. The proposed combination of MP and loop radiators compensates for LHCP field in a wide angle sector.

To reduce overall dimensions, the space between the radiating patch and the ground patch of the MP radiator can be filled with a dielectric, or a slowing structure can be installed, for example, made as a set of conductive periodic elements, or a set of capacitive impedance elements can be used, which are arranged along the perimeter of the ground patch and/or the radiating patch of the MP radiator. The elements of the slowing structure can be a set of separate ribs, or combs, or teeth, or pins. Capacitive elements are also a set of separate ribs, or combs, or teeth, or pins. As another embodiment, the dielectric filler can have grooves/slots where two-wire transmission lines are located to connect the power circuit to the loop radiator, or it can be made in the form of two dielectric segments between which power lines are located.

A compact dual-band antenna system is proposed to receive signals from two frequency bands, comprising an active high-frequency MP radiator, under which there is an active low-frequency radiator. Each of the active radiators includes a radiating patch disposed under the corresponding ground plane. MP radiators are excited, for example, by electric pins or slots powered by power circuits of the corresponding frequency band. The radiating patch of the active LF band serves as a ground plane of the active HF MP radiator, and in the vicinity of the active HF radiator, there is a loop HF radiator, which is in axial alignment with the active HF radiator. Under the ground patch of the active LF radiator, there is a passive LF radiator at a certain distance from the ground plane, which is an MP radiator as well. This MP radiator is excited by electromagnetic coupling with the active LF MP radiator.

Another embodiment has an active HF loop radiator which is excited by two-wire lines connected to the HF loop radiator power circuit at least at one point. To provide a uniform excitation field, four excitation points are preferably used. The power circuits excite two-wire lines with equal amplitudes, with a sequential phase shift of −90° ensuring excitation of RHCP waves in the front hemisphere. The antenna system also includes an HF dividing circuit, the input of which is the HF antenna input, and the power circuits of HF MP and loop radiators are connected to the outputs. The power circuits provide anti-phase excitation of LHCP waves for HF MP and loop radiators in the rear hemisphere. The LF active radiator input is the LF antenna input.

In another embodiment, the LF passive radiator can be a loop coaxially disposed at a certain distance from the bottom active LF radiator.

In another embodiment, the LF loop radiator can also be active and excited similarly to the active HF loop radiator described above.

The HF or LF loop radiator is a conductive ring to which inductive elements can be sequentially connected. The vertical symmetry axis of the LF or HF loop radiator coincides with the symmetry axis of the corresponding HF or LF MP radiators.

In another embodiment, HF or LF loop radiator can be arranged at an equal distance from the surface of the corresponding radiating and ground patches or be shifted toward the ground patch, for example, be in the same plane as the ground patch or lower than the ground patch.

A cavity where power circuits of loop radiators and MP radiator of the corresponding band are easily installed can be directly under the ground patch of the LF radiator.

In another embodiment, slot excitation can be used to excite MP radiators in the above-said structures.

Additional features and advantages of the invention will be set forth in the description that follows. Yet further features and advantages will be apparent to a person skilled in the art based on the description set forth herein or may be learned by practice of the invention.

The advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 1*a* shows a conventional antenna system.

FIG. 1*b* shows a conventional dual-band antenna based on a stacked construction.

DETAILED DESCRIPTION OF THE INVENTION

Reference will now be made in detail to the embodiments of the present invention, examples of which are illustrated in the accompanying drawings.

This described apparatus suppresses LHCP field in a wide angle sector of the rear hemisphere and reduces overall antenna dimensions. This is achieved by an antenna design comprising a MP radiator and an additional radiator in the form of a conductive loop disposed around and coaxially with the main MP radiator. Suppression of radiation in the rear hemisphere is the result of field interference of two radiators. The dimensions of the antenna are smaller than that of the conventional design.

Below there are given variants of antenna design with active and passive excitation of the loop radiator.

Figure 2:
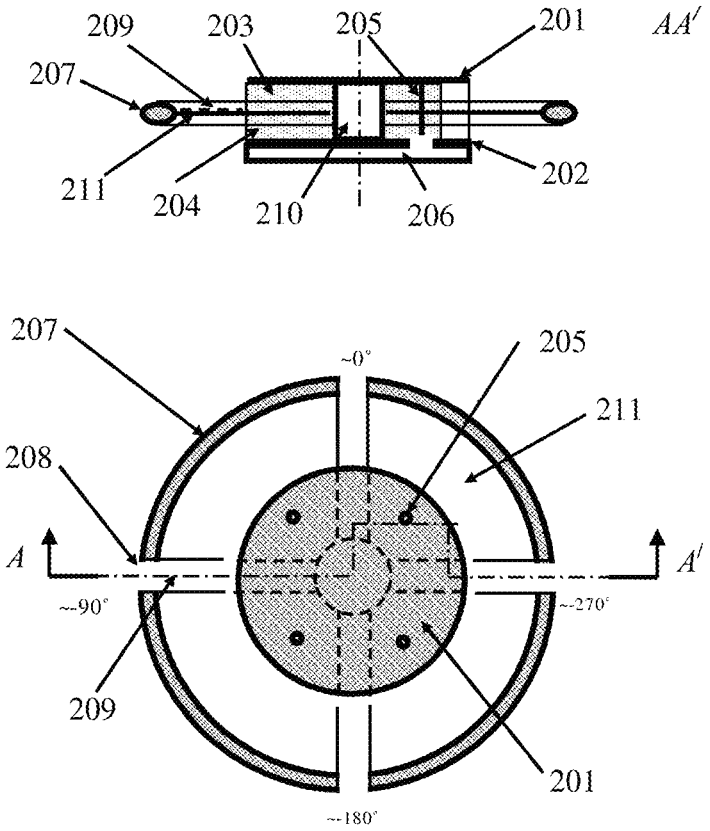
FIG. 2 shows a section view above the proposed antenna system comprising a MP radiator, and a loop radiator in the form of a wire ring.

FIG. 2 shows an antenna design with an actively-excited loop radiator. The design includes a MP radiator, which comprises radiating patch 201 disposed above flat metal ground plane 202. Between them there is a layer filled with air or a dielectric. To excite the MP radiator, electric pins 205 are used, which are galvanically contacted with the radiating patch 201. The pins are connected to the MP radiator powering circuit through holes in ground plane 202. The power circuit is installed over ground plane 202 in screened cavity 206.

In another embodiment, excitation of MP radiators can be implemented with the help of slots in metal ground plane 202 or radiating patch 201. Another embodiment, the power supply circuit of MP radiator can be installed in a different location, e.g., on the radiating patch 201.

Standard methods of exciting circularly-polarized waves are used, for example, using two electric pins. However, four-pin excitation scheme permits achieving more uniformity of field in the azimuth. In the design shown in FIG. 2, four electric pins 205 are mounted symmetrically relative to the vertical symmetry axis of radiating patch 201.

To reduce overall dimensions of the MP radiator, space between patch 201 and ground plane 202 can be partially or fully filled with a dielectric. In this case, actual dimensions of the radiator decrease by $\sqrt{\varepsilon_{\ni}}$ times (where $\varepsilon_{\ni}$ is the effective dielectric permeability, which is equal to dielectric permeability of the dielectric material if the space is fully filled with dielectric). In the design of FIG. 2 the dielectric filler is made in the form of two dielectric discs 203 and 204 with holes for exciting pins 205 and cavity 210. Between these elements, there are two-wire lines 209 to power the loop radiator, and a reference dielectric patch 211 to fix it.

At least one loop radiator 207 is installed coaxially with the MP radiator. The loop radiator 207 is made of conductive material, for example, wire, thin plates or film with dielectric substrate. The dielectric substrate serves as structural basis 211 for the loop radiator. A few loop radiators arranged vertically, one over another at a certain distance, can be used. A dielectric hollow cylinder can serve as a basis for the radiators.

FIG. 2 shows a wire ring which is fixed on the dielectric patch 211 clipped between dielectric discs 203 and 204. The length of the loop 207 is equal to about the wavelength of the antenna operating band. The loop radiator 207 has four excitation points 208, which are powered by the power circuit in the cavity 210 via two-wire lines 209. This cavity 210 can be in the middle of the radiator, as well as at any other place. Two-wire lines are preferable due to their symmetry, but different line types can be used as well, for example, coaxial or micro-strips. Power circuits 206 and 210 provide amplitude-phase relationship of power signals (equality of amplitudes and −90° phase shift), which are needed to excite RHCP waves. RHCP waves are excited in the front hemisphere.

The antenna design includes also a dividing circuit that powers the powering circuits 206 and 210. The dividing circuit can be disposed, for example, in the cavity 206 together with the powering circuit of MP radiator. The antenna input is the input of the dividing circuit. The dividing circuit ensures such amplitude-phase relationship of the powering signals that LHCP waves of the loop and MP radiators would be anti-phase added in the rear hemisphere. The dividing circuit can be made by any known method, for example, using micro-strip lines. To decouple/isolate the MP and loop radiators, the latter is preferably located equidistantly from the patches 201 and 202 of the MP radiator.

Another embodiment that reduces MP radiator dimensions includes a slowing structure in the form of a periodic sequence of conductive elements shaped as ribs, combs or pins. This structure is installed in the space between radiating patch 201 and ground plane 202, instead of a dielectric filler. The slowing structures are disposed on one of the patches 201 and 202 or on both patches, opposite with a half-period shift.

Figure 3:
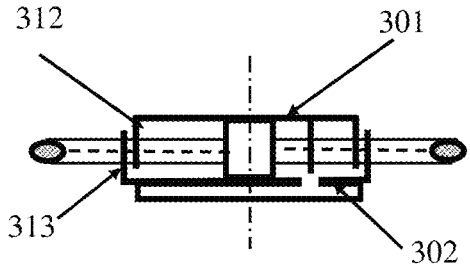
FIG. 3 shows a proposed antenna with capacitive elements in the form of conductive petals/lobes.

FIG. 3 shows an antenna design with smaller dimensions of MP radiator and without a slowing structure. In this case, capacitive impedance elements in the form of conductive strips or teeth 312 and 313, connected to radiating patch 301 and ground plane 302, respectively, are installed along the perimeter of radiating patch 301 and ground plane 302. Strips 312 and 313 are arranged perpendicularly to the plane of patches 301 and 302 in pairs opposite to each other with a gap.

Figure 4:
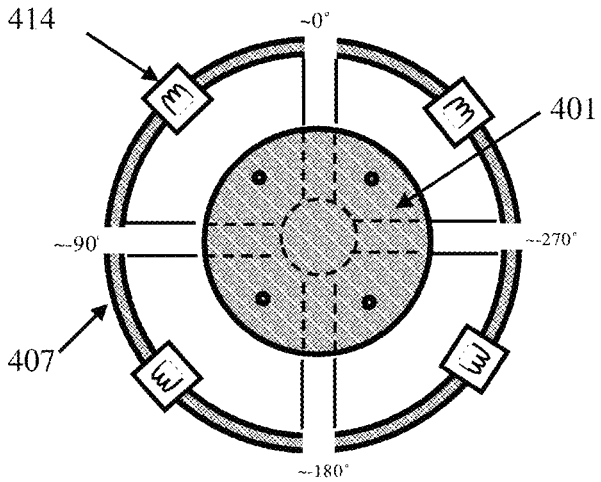
FIG. 4 shows a proposed antenna system with inductive elements.

To reduce outer dimensions of the loop radiator shown in FIG. 4, it can be made as conductor legs 407, in whose gaps elements with inductive impedance 414 are included.

Figure 5:
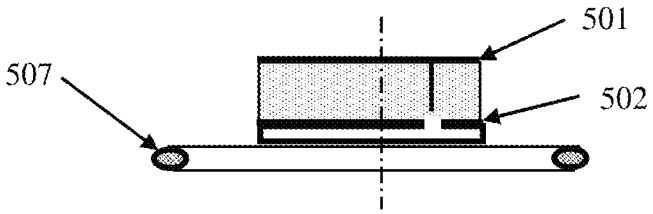
FIG. 5 shows a section view above of the proposed antenna system with a loop radiator shifted towards the ground patch of the MP radiator.

FIG. 5 shows a design with passive excitation. A loop radiator does not have its electric excitation circuit, and it is excited by the field of the MP radiator. Efficient excitation of loop radiator 507, is provided if it is located in the vicinity of the plane of ground patch 502, for example, at the same level or slightly below.

Figure 6:
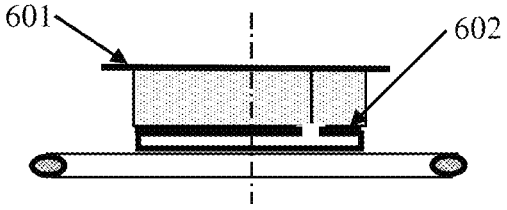
FIG. 6 shows a proposed antenna system with passive excitation, where the diameter of the radiating patch is larger than the ground patch diameter.

FIG. 6 shows that the dimensions of radiating patch 601 can be larger than dimensions of ground plane 602, i.e., the radiating patch becomes a ground plane and vice versa. Such an arrangement guarantees more efficient excitation of the loop radiator for a passively-excited system.

Figure 7:
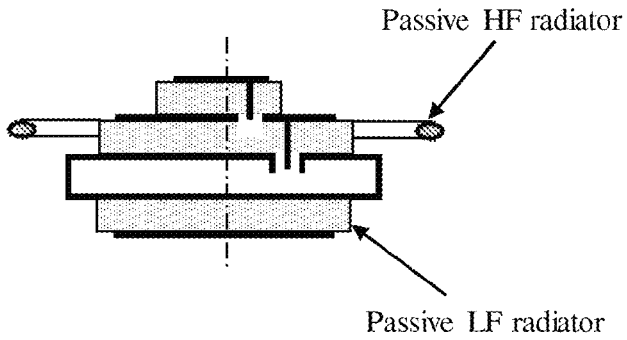
FIG. 7 shows a proposed dual-band antenna with a passive HF loop radiator and a passive LF MP radiator.

FIG. 7 shows a proposed dual-band stacked antenna design. In it, a loop radiator located close to the active HF radiator is a passive HF radiator. It enables to provide better coupling between active and passive HF radiators. The passive LF radiator still has a micro-strip form.

The versions described in FIGS. 2-6 can be used for making dual-band antennas.

Figure 8:
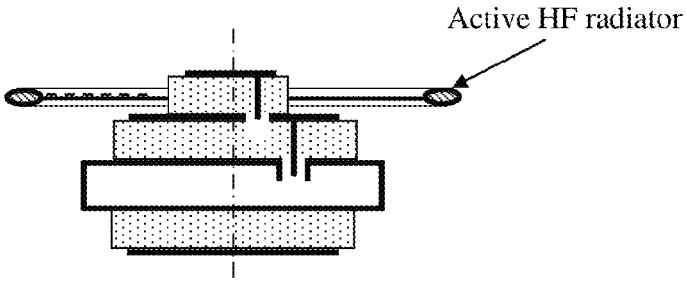
FIG. 8 shows a proposed dual-band antenna with an active loop radiator of HF band and a passive MP radiator of LF band.

Another embodiment is shown in FIG. 8. A loop radiator of the HF band is active and excited similarly to the single-band variant. The loop radiator can have four excitation points that are powered from the loop radiator power circuit through two-wire lines.

Figure 9:
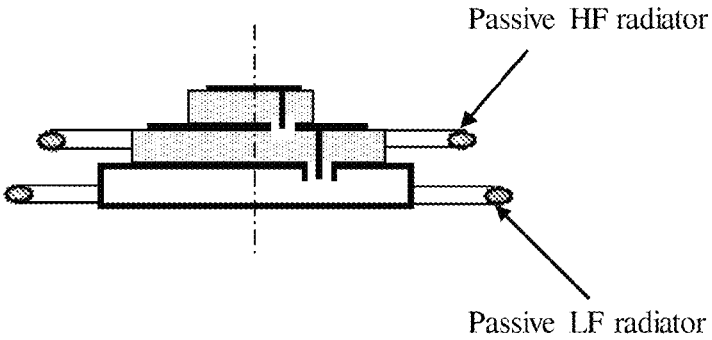
FIG. 9 shows a proposed dual-band antenna with passive loop radiators of the LF and HF bands.

Another embodiment of FIG. 9 shows passive loop radiators for LF and HF bands. The use of active loop LF and HF radiators is possible with the corresponding power circuits of the loop radiators, two-wire transmission lines and dividing circuits for LF and HF bands. Dividing circuits ensure anti-phase addition of LHCP fields in the rear hemisphere for each band. Their inputs are the corresponding antenna inputs for each of the bands.

Antenna designs shown in the drawings have circularly-shaped ground plane, MP and loop radiators, but they are not limited by this shape and can have square, rectangular or any other similar shape.

Figure 10:
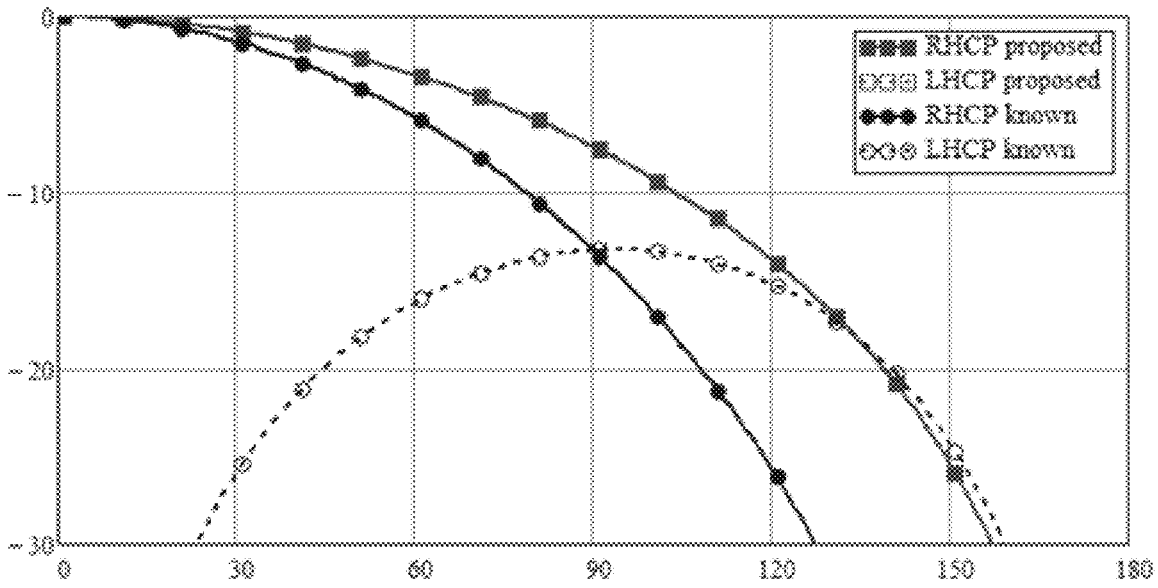
FIG. 10 illustrates DD calculation results for the proposed antenna system.
Figure 11:
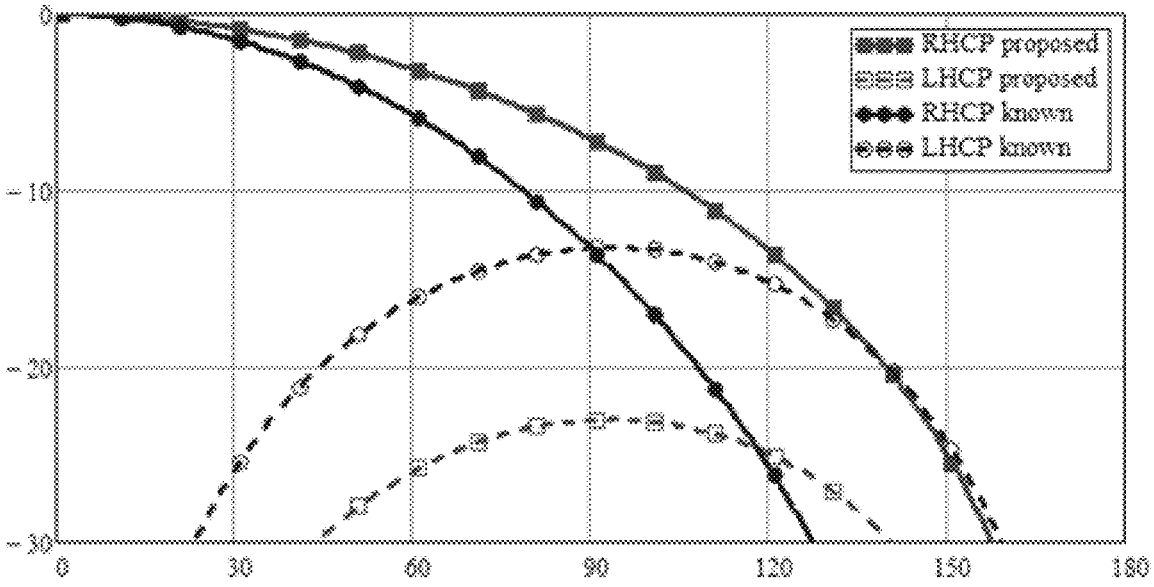
FIG. 11 illustrates DD calculation results for the case of a shifted loop radiator (i.e., shifted towards the ground plane).
Figure 12:
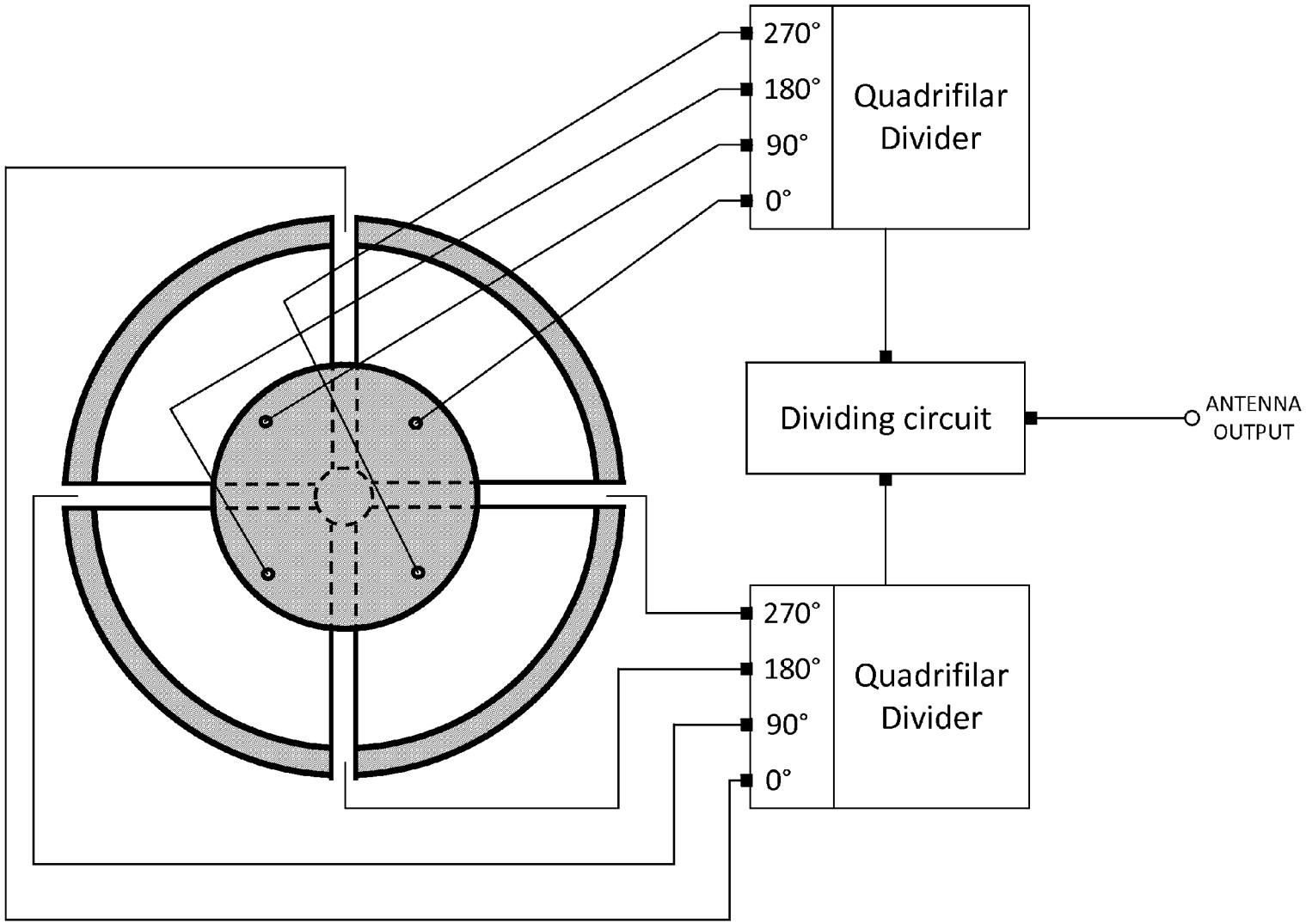
FIG. 12 illustrates a dividing circuit for providing anti-phase excitation of LHCP waves in the patch and loop radiators in a rear hemisphere.
Figure 13:
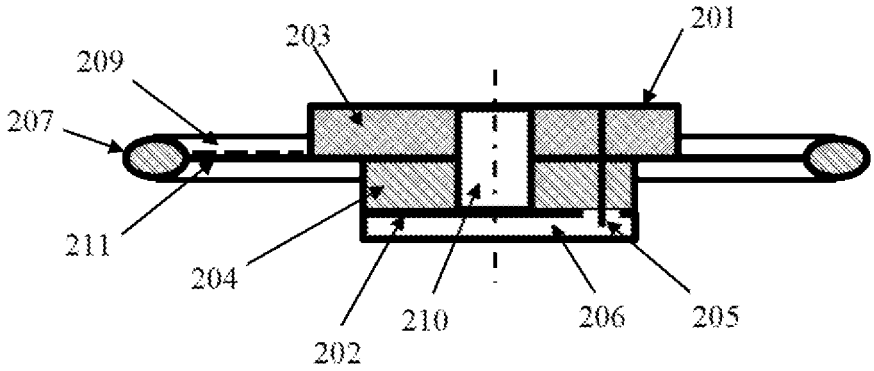
FIG. 13 illustrates an embodiment with the loop radiator at the same distance from a surface of the radiating patch and the ground plane.

FIGS. 10 and 11 show computational DD characteristics for the considered antenna designs and the prototype. Computational principles and main relationships are given below, in Annex 1.

Figure 1A:
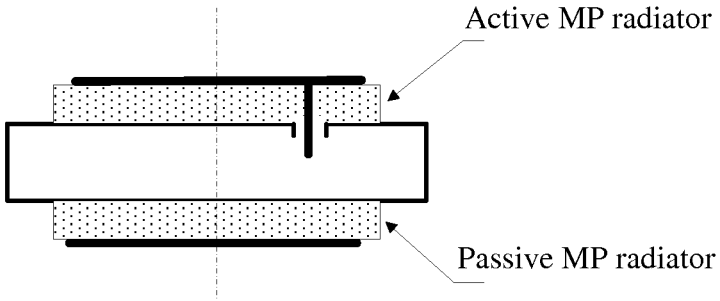
Fig. 1a CONVENTIONAL ART
Figure 1B:
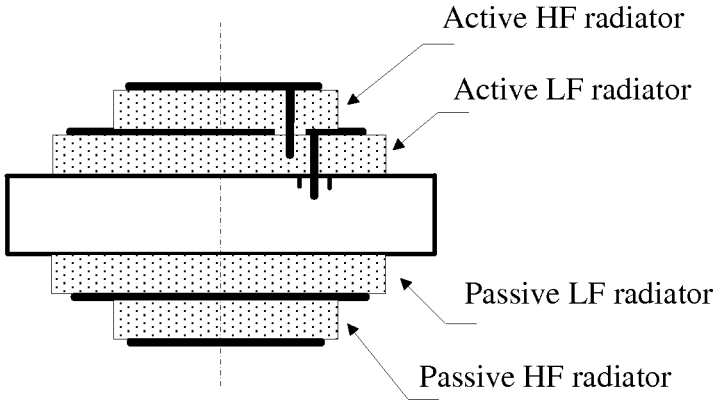

FIG. 10 as an example illustrates DD computational results according to expressions (4)-(7) for the proposed design (square) and prototype (FIG. 1*a*) (designated by circles), when diameters of the radiating patch and loop filter are equal to 0.2λ. In the proposed design, the loop radiator is equidistant from patches of radiator 201 and ground plane 202 (FIG. 2). In an approximation of the computational model, there is no LHCP field in the proposed antenna design.

FIG. 11 shows antenna DD computational results for the design wherein the loop radiator is shifted towards ground plane 502 by 0.05λ. In this case there is LHCP field, but it is much less than in the conventional case.

Annex 1

A patch radiator is a resonator cavity formed by a ground plane and a radiating patch loading for slot radiation admittance. Slot radiation can be described as radiation of a magnetic current filament. If the radiating patch is circularly shaped, the magnetic current filament is a circle. When right-hand circularly polarized field is excited, the density of magnet current has an azimuthal dependence (in angle $\phi$) of type $e^{-i\Phi}$. A loop radiator can be presented as a ring of electric current whose density has also azimuthal dependence $e^{-i\Phi}$.

Expressions for a directional diagram for magnetic and electric current can be obtained by integrating Green's function over area of the current source (see Y. T. Lo, S. W. Lee "Antenna Handbook" v. 2, Van Nostrand Reinhold, 1993). As a result we have:

$$\vec{F}_m(\theta) = \vec{\theta}_0 I_1(\theta) + \vec{\varphi}_0 \cos(\theta)\frac{I_2(\theta)}{i} \tag{1}$$

$$\vec{F}_e(\theta) = \vec{\theta}_0\left(-\cos(\theta)\frac{I_2(\theta)}{i}\right) + \vec{\varphi}_0 I_1(\theta) \tag{2}$$

Expression (1) describes DD of magnetic current ring, and (2) describes DD of electric current ring. In (1) and (2) integration functions $I_1(\theta)$ and $I_2(\theta)$ from meridian coordinate $\theta$ are determined as follows:

$$I_1(\theta) = \frac{1}{\pi}\int_0^{2\pi} e^{-i\varphi} e^{ikR\sin(\theta)\cos(\varphi)}\cos(\varphi)\,d\varphi; \tag{3}$$

$$I_2(\theta) = \frac{1}{\pi}\int_0^{2\pi} e^{-i\varphi} e^{ikR\sin(\theta)\cos(\varphi)}\sin(\varphi)\,d\varphi.$$

here R is the radius of the electric or magnetic current ring, $k=2\pi/\lambda$ is the wavenumber, $\lambda$ is the wavelength.

In practice, the radius of the loop radiator is a little larger than the radius of the radiating patch of the MP radiator. For the sake of simplification, they are assumed to be equal. Correspondingly, radii of the rings of electric and magnetic currents are equal too.

Antenna field can be represented as a sum of fields formed by MP and loop radiators:

$$\vec{F}(\theta)=\vec{F}_m(\theta)+A\vec{F}_e(\theta)e^{-ikh\cos(\theta)} \tag{4}$$

Here $\vec{F}(\theta)$ is the DD of MP radiator, $\vec{F}_e(\theta)$ is the DD of the loop radiator, A is the amplitude multiplier which determines the excitation level of the loop radiator, $e^{-ikh\cos(\theta)}$ is the multiplier describing possible vertical isolation of MP and loop radiators which depends on the vertical distance $h\geq 0$ between MP and loop radiators. Angle $\theta$ is read out from the normal to the surface of the radiating patches. Value A is selected considering the absence of left polarization at $\theta=180°$. To find it, vectors $\vec{F}_m(\theta)$ and $\vec{F}(\theta)$ are written in the orthonormal basis formed by the vectors of right $\vec{r}_0$ and left $\vec{l}_0$ circular polarization:

$$\vec{r}_0 = \frac{1}{\sqrt{2}}\left(\vec{\theta}_0 - i\vec{\varphi}_0\right)$$

$$\vec{l}_0 = \frac{1}{\sqrt{2}}\left(i\vec{\theta}_0 - \vec{\varphi}_0\right)$$

Then from (1) and (2):

$$\vec{F}_m(\theta)=\vec{r}_0 I_a(\theta)+\vec{l}_0 iI_b(\theta) \tag{5a}$$

$$\vec{F}_e(\theta)=\vec{r}_0 iI_a(\theta)+\vec{l}_0 I_b(\theta) \tag{5b}$$

Here:

$$I_a(\theta) = \frac{1}{\sqrt{2}}(I_1(\theta) + \cos(\theta)I_2(\theta))$$

$$I_b(\theta) = \frac{1}{\sqrt{2}}(-iI_1(\theta) + \cos(\theta)I_2(\theta))$$

From (4), the full field is:

$$\vec{F}(\theta)=\vec{r}_0 I_a(\theta)(1+Aie^{-ikh\cos(\theta)})+\vec{l}_0 I_b(\theta)(i+Ae^{-ikh\cos(\theta)}) \tag{6}$$

Considering the condition of vanishing left polarized constituent of the vector results in:

$$A=-ie^{-ikh} \tag{7}$$

Then $$\vec{F}(\theta)=\vec{r}_0 I_a(\theta)(1+e^{-ikh[\cos(\theta)+1]})+\vec{l}_0 iI_b(\theta)(1-e^{-ikh[\cos(\theta)+1]}) \tag{8}$$

From (8) it is seen that at the left polarized component becomes zero at any random $\theta$, and the right polarized component doubles. This means that there is full subtraction of LHCP fields of MP and loop radiators and following addition of their fields of RHCP in the full sector of angles $\theta$. This case corresponds to the embodiment with active excitation of the loop radiator when the loop radiator is located in the horizontal symmetry plane of the MP radiator.

Prototype DD can be described as a sum of fields for active and passive MP antennas, respectively:

$$\vec{F}(\theta)=\vec{F}_{ma}(\theta)+A\vec{F}_{mp}(\theta)e^{-ikh\cos(\theta)} \tag{9},$$

Here $\vec{F}_{ma}(\theta)$ is the DD of active MP radiator, $\vec{F}_{mp}(\theta)$ is the DD of passive MP radiator, A is the amplitude multiplier determining the excitation level of the passive radiator, $e^{-ikh\cos(\theta)}$ is the multiplier describing vertical isolation of the active and passive radiators as a function of the distance h between them. Note that in this case $h\neq 0$, since the passive radiator is above the active one. $\vec{F}_{ma}(\theta)$ and $\vec{F}_a(\theta)$ are calculated according to (1). The amplitude multiplier A is selected considering the condition of absence of LHCP field at $\theta=180°$. In this case $$A=-e^{-ikh} \tag{10},$$

and full compensation for LHCP field is possible only at $\theta=180°$.

Having thus described a preferred embodiment, it should be apparent to those skilled in the art that certain advantages of the described method and apparatus have been achieved.

It should also be appreciated that various modifications, adaptations, and alternative embodiments thereof may be made within the scope and spirit of the present invention. The invention is further defined by the following claims.

What is claimed is:

1. An antenna system comprising:

a patch circularly-polarized radiator including a radiating patch disposed above a ground plane, and a loop radiator coaxially aligned with the patch circularly polarized radiator and located between the radiating patch and the ground plane, wherein the ground plane has a smaller diameter than the radiating patch, and wherein the loop radiator is formed of multiple sections with gaps between the multiple sections.

2. The antenna system of claim 1, further comprising a transmission line connected to the loop radiator; and a power circuit connected to the transmission line for providing circular polarization excitation of the loop radiator.

3. The antenna system of claim 2, wherein the power circuit enables the excitation of an RHCP wave in a direction of antenna directional diagram maximum.

4. The antenna system of claim 1, wherein the patch circularly-polarized radiator is excited by utilizing a plurality of pins or slots.

5. The antenna system of claim 4, further comprising a dividing circuit, such that the power circuit of the loop radiator and the patch circularly-polarized radiator are connected to inputs of the dividing circuit, wherein the dividing circuit provides anti-phase excitation of LHCP waves in the patch and loop radiators in a rear hemisphere.

6. The antenna system of claim 1, wherein the loop radiator is in a form of a conductive ring.

7. The antenna system of claim 1, further comprising inductive impedance elements sequentially connected to the loop radiator.

8. The antenna system of claim 1, wherein a vertical symmetry axis of the loop radiator matches a vertical symmetry axis of the antenna system.

9. The antenna system of claim 1, wherein the loop radiator is at the same distance from a surface of the radiating patch and the ground plane.

10. The antenna system of claim 1, wherein the loop radiator is offset along a vertical symmetry axis towards a surface of the ground plane.

11. The antenna system of claim 1, wherein space between the radiating patch and ground plane includes any of (a) dielectric filler, (b) a slowing structure, and (c) capacitive elements along a perimeter of the radiating patch and/or the ground plane.

12. The antenna system of claim 11, wherein the slowing structure and the capacitive elements are in a form of separate ribs, combs or pins.

13. The antenna system of claim 11, wherein in the space between the radiating patch and the ground plane includes transmission lines which excite circularly-polarized waves from a power circuit of the loop radiator.

14. An antenna system comprising:

a patch circularly-polarized radiator including a radiating patch disposed above a ground plane, and a loop radiator coaxially aligned with the patch circularly polarized radiator and located below the radiating patch and below the ground plane, wherein the ground plane has a diameter that is smaller or the same as the radiating patch, and wherein the loop radiator is formed of multiple sections with gaps between the multiple sections.

15. An antenna system comprising:

a patch circularly-polarized radiator including a radiating patch disposed above a ground plane, and a loop radiator coaxially aligned with the patch circularly polarized radiator and located between the radiating patch and the ground plane, wherein the ground plane has a diameter that is larger or the same as the radiating patch, and wherein the loop radiator is formed of multiple sections with gaps between the multiple sections.

* * * * *